US006653944B2

(12) United States Patent
Huang et al.

(10) Patent No.: US 6,653,944 B2
(45) **Date of Patent: *Nov. 25, 2003**

(54) SEMICONDUCTOR WAFER TRANSPORT POD EQUIPPED WITH COVER LATCH INDICATOR

(75) Inventors: Hsin-Chieh Huang, Hsin-Chu (TW); Am-Ming Chiang, Hsin-Chu (TW)

(73) Assignee: Taiwan Semiconductor Manufacturing Co. Ltd, Hsin Chu (TW)

( * ) Notice: Subject to any disclaimer, the term of this patent is extended or adjusted under 35 U.S.C. 154(b) by 0 days.

This patent is subject to a terminal disclaimer.

(21) Appl. No.: 09/910,634

(22) Filed: Jul. 20, 2001

(65) Prior Publication Data

US 2003/0016137 A1 Jan. 23, 2003

(51) Int. Cl.[7] ..... G08B 21/00

(52) U.S. Cl. ..... 340/687; 340/686.1; 340/680; 340/542; 250/559.29; 250/559.37; 250/559.33; 250/548; 250/221

(58) Field of Search ..... 340/687, 686.1, 340/680, 542; 250/559.29, 559.37, 559.33, 548, 221

(56) References Cited

U.S. PATENT DOCUMENTS

| | | | | | |
|---|---|---|---|---|---|
| 4,995,430 | A | * | 2/1991 | Bonora et al. | 141/98 |
| 5,868,803 | A | * | 2/1999 | Chen | 29/25.01 |
| 5,967,571 | A | * | 10/1999 | Gregerson | 292/33 |
| 6,082,949 | A | * | 7/2000 | Rosenquist | 414/217 |
| 6,160,265 | A | * | 12/2000 | Bacchi et al. | 250/559.29 |
| 6,340,933 | B1 | * | 1/2002 | Chen et al. | 340/687 |

* cited by examiner

*Primary Examiner*—Daniel J. Wu
*Assistant Examiner*—Tai T. Nguyen
(74) *Attorney, Agent, or Firm*—Tung & Associates

(57) ABSTRACT

A pod for transporting a cassette of semiconductor wafers that is equipped with a cover latch indicator is described. The pod is constructed by a base, a cover, a latch means and an indicator means. The base is used to support the cassette positioned thereon, while the cover removably carries on the base for protectively covering the cassette to prevent contamination of the wafers. The latch means is carried on the base for latching the cover onto the base. The latch means may be actuatable from a latched position in which the cover is latched onto the base to a released position allowing removal of the cover from the base. The indicator means is coupled with the latch means for providing a visual indication of the condition of the latch means.

16 Claims, 1 Drawing Sheet

SEMICONDUCTOR WAFER TRANSPORT POD EQUIPPED WITH COVER LATCH INDICATOR

FIELD OF THE INVENTION

The present invention generally relates to a pod for transporting a cassette of semiconductor wafers and more particularly, relates to a semiconductor wafer transport pod equipped with a cover latch indicator to ensure that a cover is latched onto a base before the pod is picked up by an operator.

BACKGROUND OF THE INVENTION

The high level of automation used in fabricating semiconductor devices relies on sophisticated handling and transport equipment for moving semiconductor wafers between various processing stations. Most handling and transport operations are conducted under automatic control using a programmed computer which issues control signals for operating the equipment with little or no intervention by an operator. In many systems, standard mechanical interface (SMIF) pods are used to transport batches of wafers that are stored in cassettes. These pods include a base upon which the cassettes rest, and a cover removably secured to the base and completely enclosing the cassette. The cover protectively surrounds the cassette, and thus the wafers, from the surrounding environment which may contain airborne, contamination particles. SMIF pods are most often used to transport cassettes from one clean room environment to another, where during the transport movement, the wafers, if not covered, are exposed to the contaminating environment.

After a pod has reached the vicinity of a processing station within a protected, clean room environment, it is necessary to remove the cover so that automated wafer transfer robots can gain access the individual wafers held in the cassette. The covers are held on the pods by various types of latching mechanisms which are automatically actuated to latch and unlatch the cover by means of actuating controls positioned at each processing station. Thus, when a pod reaches a processing station, control mechanisms engage the latch mechanism on the pod to unlatch the cover, following which either an operator or a robotic mechanism removes the cover to expose the cassette. Following processing of a batch of wafers in the cassette, the cover is reinstalled on the pod base, either manually or robotically, after which the control mechanism is actuated to latch the cover on the base before the pod leaves the processing station.

Referring first to FIG. 1, in accordance with the prior art, a pod includes a generally rectangular base 15 upon which there is supported a cassette 12 containing a plurality of vertically spaced, semiconductor wafers (not shown) disposed in stacked relationship to each other. The pod also includes a cover 10 disposed over and protectively enclosing the cassette 12. The cover 10 is provided with a peripheral flange 17 which engages an edge of the base 15, so that the cover 10 is carried on the base 15. A tag 36 is secured to one face of the cover 10 and is used to identify the pod and/or its contents. The tag 36 may comprise a simple bar code device or, an electronic device that can be automatically read by an electronic reader.

The cassette 12 is held on the base 15 by means of an H Bar 18. The H Bar 18 forms a part of the top side of the base, and cooperates to receive a locking member on the base of the cassette 12, in a bayonet like manner.

The base 15 includes a pair of outwardly slidably latch plates 16 having outer fingers 26 which are received in indentations or other recesses (not shown) on the inside wall of the cover 10 in order to lock the cover 10 on the base 15. The latch plates 16 are driven by a circular rotatable plate 24 having a pair of drive pins 28 on the outer periphery thereof. The drive pins 28 are received within elongated slots (not shown) respectively in the latch plates 16. The circular plate 24 is in turn driven by a pair of latch pins 42 that are driven to rotate by other apparatus present at the processing station (not shown) where the pod is delivered in order to load or unload wafers therefrom. Rotation of the plate 24 causes the drive pins 28 to move the latch plate 16 outwardly so that the fingers 26 move into retainers or indentations in the cover 10, thereby latching the latter in place. However, in the event of slight misalignment or tilting of the cover 10 relative to the base 15, or where there is a failure of any of the mechanical driving components, the cover 10 may fail to be properly latched down onto the base assembly 15 but such latching failure is not readily detectable by an operator.

In spite of the fact that positive latch mechanisms are employed to lock the cover on the pod base, occasions arise when, for a variety of reasons, the latch fails to lock the cover on the pod base. This may occur, for example, when a foreign article becomes lodged between the cover and the base or where the cassette becomes tilted on the base, thus interfering with proper seating of the cover. In other cases, the control mechanism for actuating the latch may malfunction. In many cases, failure of the latch mechanism to lock the cover on the pod base goes undetected by process operators. As a result, it is possible that contaminants may pass between the pod base and cover when the pod leaves the clean room environment, thereby resulting in possible contamination of the wafers.

Accordingly, there is a clear need in the art for an improved pod construction which provides a positive indication of when the cover is properly locked down on the pod base. The present invention is directed toward satisfying this need in the art.

It is therefore an object of the present invention to provide a pod for transporting a cassette of semiconductor wafers that does not have the drawbacks or shortcomings of the conventional pods.

It is another object of the present invention to provide a pod for transporting a cassette of semiconductor wafers that is equipped with a cover latch indicator.

It is a further object of the present invention to provide a semiconductor wafer transport pod that is constructed by a base, a cover, a latch means, and an indicator means.

It is another further object of the present invention to provide a semiconductor wafer transport pod equipped with a latch means including four latch keys, a power source and a wiring means in-between the four latch keys.

It is still another object of the present invention to provide a semiconductor wafer transport pod that is equipped with an indicator means of a light emitting diode which is lit when all latch keys are latched onto the cover of the pod.

SUMMARY OF THE INVENTION

In accordance with the present invention, a pod for transporting a cassette of semiconductor wafers that is equipped with a cover latch indicator is provided.

In a preferred embodiment, a pod for transporting a cassette of semiconductor wafers is provided which includes a base for supporting the cassette thereon; a cover removably carried on the base for protectively covering the cassette; latch means carried on the base for latching the cover on the base, the latch means is actuatable from a latched position in which the cover is latched on the base to a released position allowing removal of the cover from the base; an indicator means coupled with the latch means for providing a visual indication of the condition of the latch means.

In the pod for transporting a cassette of semiconductor wafers, the latch means may further include at least four latch keys situated around the base, each has an electrically conductive path between two ends of the key; a power source sufficient to activate the indicator means; and wiring means in-between the at least four latch keys, the power source and the indicator means, such that only when all four latch keys are in a latched position, electrical current flows through the wiring means to activate the indicator means. The indicator means may be a light emitting diode, or an indicator lamp. The power source may be a DC power source carried on the base, or a 1.5 V DC battery situated on the base. The wiring means connects the at least four latch keys in series. Each of the at least four latch keys may be situated in a latch key socket that has two electrical switch contacts for connecting by the electrical conductive path on the key. The indicator means may be positioned on a top surface of the cover. The latch means may include four latch keys with two situated on each opposite side of the base.

The present invention is further directed to a pod for transporting a cassette containing a plurality of semiconductor wafers that includes a base for supporting the cassette thereon; a cover removably carried on the base for protectively covering the cassette; latch means carried on the base for latching and unlatching the cover on the base; and means for issuing a visual indication when the cover is latched on the base.

In the pod for transporting a cassette that contains a plurality of semiconductor wafers, the latch means may include four latch keys situated spaced-apart on the base. The means for issuing a visual indication includes an electrical power source, an indicator lamp, and electrical switch means coupled with the power source and the indicator lamp, and actuated by the latch means. The indicator lamp may be a light emitting diode, or a light emitting diode that emits green light. The electrical switch means may further include wiring means connecting the four latch keys in series. The electrical switch means remains in an un-switched position if any one of the four latch keys is in an un-latched position. The electrical power source may be a 1.5 V DC battery. The electrical switch means may further include four latch key sockets each equipped with two electrical switch contacts for connecting by the latch key. Each of the four latch keys may be provided with an electrically conductive path between two ends of the key.

BRIEF DESCRIPTION OF THE DRAWINGS

These and other objects, features and advantages of the present invention will become apparatus from the following detailed description and the appended drawings in which.

DETAILED DESCRIPTION OF THE PREFERRED EMBODIMENT

The present invention discloses a pod for transporting a cassette of semiconductor wafers which includes a base, a cover, a latch means and an indicator means.

The base of the pod is used for supporting a cassette thereon, while the cover is removably carried on the base for protectively covering the cassette. The latch means is carried on the base for latching the cover onto the base. The latch means is actuatable from a latched condition in which the cover is latched onto the base to a released position allowing removal of the cover from the base. The indicator means is coupled with the latch means for providing a visual indication of the condition of the latch means.

In a preferred embodiment, the latch means includes four latch keys that are situated around the base, each has an electrically conductive path between two ends of the key, a power source that is sufficient to activate the indicator means, and a wiring means in-between the four latch keys, the power source and the indicator means, such that only when all of the four latch keys are in a latched position electrical current flows through the wiring means to activate the indicator means. The indicator means is a light emitting diode in the preferred embodiment. The power source is a 1.5 V DC battery in the preferred embodiment.

Figure 1:
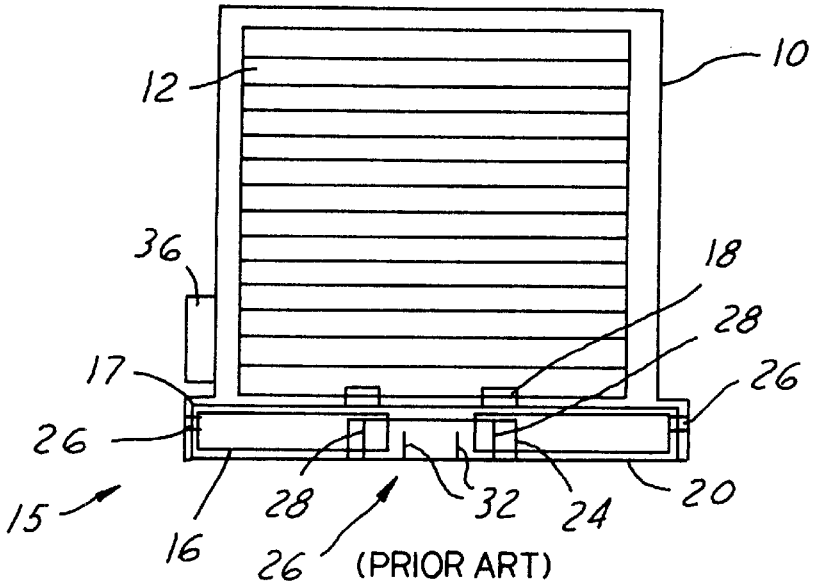
FIG. 1 is a cross-sectional view of a conventional semiconductor wafer transport pod.
Figure 2:
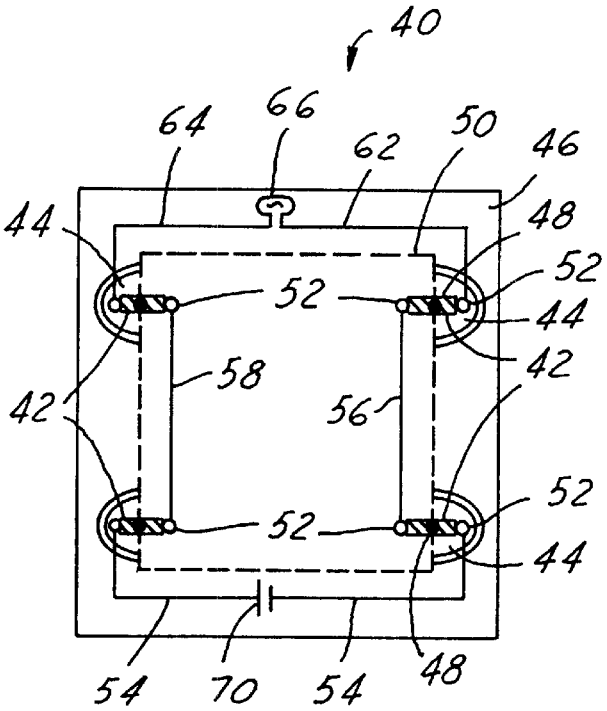
FIG. 2 is a top view of the base of the present invention semiconductor wafer transport pod.

Referring now to FIG. 2, wherein a top view of a base 40 for the present invention semiconductor wafer transport pod is shown. It should be noted that, overlapped on the base 40, it is a profile of the cover 50 shown in ghost lines in an engaged position with the base 40. The present invention cover latch indicator shown in FIG. 2 consists of four latch keys 42, each situated in a latch key socket 44 which is an area recessed into a top surface 46 of the base 40. Each of the latch key 42 is pivotally mounted to the top surface 46 of the base 40 by a mounting pin 48 which allows the latch key 42 to rotate into or out of a latched position, such as that shown in FIG. 2A.

As shown in FIG. 2, each of the latch key 42 engages two electrical switch contacts 52 to provide electrical communication between the two electrical switch contacts through a conductive path 60 provided on the latch key 42. The electrically conductive path 60 may be formed of a conductive metal foil or a metal inlay in the latch key which is preferably formed of a plastic material. Each of the electrical switch contact 52 is connected to the next adjacent electrical switch contact by an electrical wire 54 in an in-series connection. For instance, the bottom two electrical switch contacts 52, shown in FIG. 2, are connected together with an electrical power source 70 therein between. The electrical power source may be advantageously a DC power source, such as a 1.5 volt DC battery. The electrical switch contact 52 are further connected together by wirings 56, 58. The final connection between the two upper electrical switch contact 52 is made through wiring 62, 64 to an indicator means 66. The indicator means shown in the preferred embodiment is a light emitting diode. The indicator means 66 may be positioned on the base, or more suitably, positioned on the front of the base.

As shown in FIG. 2, the electrical switch means utilized in the present invention novel apparatus remains in an un-switched position if any one of the four latch keys 42 is in an un-latched position. The indicator means 66 will only lit when all four latch keys 42 are in an engaged position, i.e., are locked onto the cover 50 of the pod. The danger of lifting a wafer pod wherein the cover is not latched onto the base and thus dropping the wafers from the cassette is therefore eliminated.

Figure 2A:
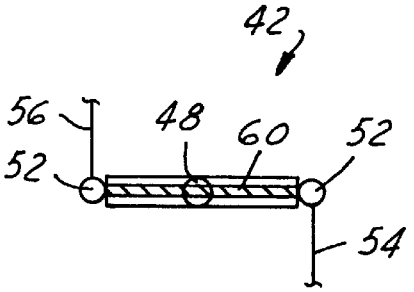
FIG. 2A is an enlarged view of the present invention latch key in an engaged position between two electrical switch contacts.
Figure 2B:
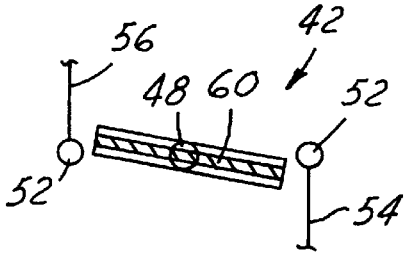
FIG. 2B is an enlarged view of the present invention latch key in an un-latched position between two electrical switch contacts.

The present invention semiconductor wafer transport pod that is equipped with a cover latch indicator has been amply described in the above description and in the appended drawings of FIGS. 2, 2A and 2B.

While the present invention has been described in an illustrative manner, it should be understood that the terminology used is intended to be in a nature of words of description rather than of limitation.

Furthermore, while the present invention has been described in terms of a preferred embodiment, it is to be appreciated that those skilled in the art will readily apply these teachings to other possible variations of the inventions.

What is claimed is:

1. A pod for transporting a cassette of semiconductor wafers comprising:

a base for supporting said cassette thereon;

a cover removably carried on said base for protectively covering said cassette;

latch means carried on said base for latching said cover on said base, said latch means being actuatable from a latched condition in which said cover is latched on said base to a released position allowing removal of said cover from said base; and indicator means coupled with said latch means for providing a visual indication of the condition of said latch means said latch means further comprises:

at least four latch keys situated around said base, each having an electrically conductive path between two ends of the key;

a power source sufficient to activate said indicator means;

wiring means in-between said at least four latch keys, said power source and said indicator means, such that only when all of the at least four latch keys are in a latched position electrical current flows through said wiring means to activate said indicator means.

2. A pod for transporting a cassette of semiconductor wafers according to claim 1, wherein said indicator means is a light emitting diode.

3. A pod for transporting a cassette of semiconductor wafers according to claim 1, wherein said indicator means is an indicator lamp.

4. A pod for transporting a cassette of semiconductor wafers according to claim 1, wherein said power source is a DC power source carried on said base.

5. A pod for transporting a cassette of semiconductor wafers according to claim 1, wherein said power source is a 1.5 V DC battery situated on said base.

6. A pod for transporting a cassette of semiconductor wafers according to claim 1, wherein said wiring means connects said at least four latch keys in series.

7. A pod for transporting a cassette of semiconductor wafers according to claim 1, wherein each of said at least four latch keys being situated in a latch key socket having two electrical switch contacts for connecting by said electrically conductive path on said key.

8. A pod for transporting a cassette of semiconductor wafers according to claim 1, wherein said indicator means being positioned on a top surface of said cover.

9. A pod for transporting a cassette of semiconductor wafers according to claim 1, wherein said latch means comprises four latch keys with two situated on each opposite side of said base.

10. A pod for transporting a cassette containing a plurality of semiconductor wafers comprising:

a base for supporting said cassette thereon;

a cover removably carried on said base for protectively covering said cassette;

latch means carried on said base for latching and unlatching said cover on said base, said latch means comprises four latch keys situated spaced-apart on said base;

means for issuing a visual indication when said cover is latched on said base, said means for issuing a visual indication comprises:

an electrical power source;

an indicator lamp; and electrical switch means coupled with said power source and said indicator lamp, and actuated by said latch means, said electrical switch means further includes four latch key sockets each equipped with two electrical switch contacts for connecting by said latch key.

11. A pod for transporting a cassette containing a plurality of semiconductor wafers according to claim 10, wherein said indicator lamp is a light emitting diode.

12. A pod for transporting a cassette containing a plurality of semiconductor wafers according to claim 10, wherein said indicator lamp is a light emitting diode that emits green light.

13. A pod for transporting a cassette containing a plurality of semiconductor wafers according to claim 10, wherein said electrical switch means further includes wiring means connecting said four latch keys in series.

14. A pod for transporting a cassette containing a plurality of semiconductor wafers according to claim 10, wherein said electrical switch means remains in an un-switched position if any one of said four latch keys is in an un-latched position.

15. A pod for transporting a cassette containing a plurality of semiconductor wafers according to claim 10, wherein said electrical power source is a 1.5 V DC battery.

16. A pod for transporting a cassette containing a plurality of semiconductor wafers according to claim 10, wherein each of said four latch keys being provided with an electrically conductive path between two ends of the key.

* * * * *